US005467875A

United States Patent [19]

Sato

[11] Patent Number: 5,467,875

[45] Date of Patent: Nov. 21, 1995

[54] MULTIPLE STRUCTURE PAPER PROTECTOR AND THE APPARATUS FOR ITS PRODUCTION

[76] Inventor: Shizuo Sato, 1608-11, Oaza-Higashi-Hongo, Kawaguchi-Shi, Saitama-Ken, Japan

[21] Appl. No.: 428,796

[22] Filed: Apr. 24, 1995

Related U.S. Application Data

[63] Continuation of Ser. No. 88,530, Jul. 9, 1993, abandoned.

[30] Foreign Application Priority Data

Jul. 13, 1992 [JP] Japan ..... 4-208514

[51] Int. Cl.[6] ..... B65D 85/30

[52] U.S. Cl. ..... 206/588; 206/591

[58] Field of Search ..... 206/521, 591, 206/594, 588, 328, 491, 492; 229/23 A

[56] References Cited

U.S. PATENT DOCUMENTS 2,836,338 5/1958 Daniels ..... 229/23 A
4,792,043 12/1988 Holladay ..... 206/594 X
5,110,037 5/1992 Pieritz, Sr. ..... 229/23 A

*Primary Examiner*—Jacob K. Ackun
*Attorney, Agent, or Firm*—Jacobson, Price, Holman & Stern

[57] ABSTRACT

A paper protector, using multiple sheets of paper, that can contain electronic goods, precision instruments or other objects requiring protection from shock, having a multiple structure provided with a primary blank (10) consisting of a central panel (11), which contacts the contained object M, inner panels (12), around the periphery of the central panel, which are set upright and surround the object, and first mid panels (13), which are folded outwardly from the extremities of the inner panels; and a secondary blank (20), consisting of a second mid panel (23) having a central opening of approximately the same form as the central panel, which surrounds the periphery of that opening and is positioned on either side of the first mid panels (13), and outer panels (24), which surround the exterior of the inner panels and are folded at an angle from the extremities of the second mid panel; and forming spaces (55) having a width equivalent to that of mid panels (13 and 23 ) and disposed between the inner and outer panels by positioning the mid panels one above the other and assembling the various components to maintain the above positional relationship.

3 Claims, 15 Drawing Sheets

MULTIPLE STRUCTURE PAPER PROTECTOR AND THE APPARATUS FOR ITS PRODUCTION

This is a continuation of application Ser. No. 08/088,530, filed Jul. 9, 1993 which was abandoned upon the filing hereof;

BACKGROUND OF THE INVENTION

1. Field of the Invention

This invention relates to a multiple structure protector made of paper formed with at least two blanks, making up the internal or external surfaces of the protector, and assembled as a three-dimensional body by means of gluing flaps provided where required.

2. Description of the Prior Art

Styrofoam is normally used to protect objects from shock, as can be seen, for example, in the packaging materials used for electronic goods. However, resinous protectors, such as molded products made of styrol, etc., or vacuum forming products made of vinyl chloride, etc., while readily allowing the formation of concavities to accommodate electronic goods or other objects, present problems in their disposal after use.

That is, first there is the problem of the immense quantities to be disposed of and, secondly, since resin does not decompose and must be incinerated, there is the problem of its adverse effect on the environment. A third problem is the waste of resources, as such protectors, which are produced by processing petroleum based raw materials, become useless once the protected object is sold.

However, that does not mean that there are no protectors which are made of substitute materials; for example, there are those made of paper material and molded to form required shapes and used to accommodate fruits or other products. However, such paper protectors are molded on cutting the paper material to form paper clay. Consequently, being easily damaged and presenting the risk of intrusion into the contained object of pulverized paper fibers, which are generated in large quantities, such protectors are not appropriate for objects such as electronic goods or precision instruments. Moreover, they also have the disadvantage of an unsightly appearance that does not match the object.

SUMMARY OF THE INVENTION

It is an object of the rpesent invention to provide a paper protector required structure which would allow objects such as electronic goods, etc., to be accommodated as they are with resinous protectors by folding, tooling, gluing, etc., multiple sheets of paper.

This and other objects have been attained by a Multiple Structure paper protector formed of at least two blanks making up the internal or external surfaces of the protector, and assembled as a three-dimensional body by means of gluing flaps provided where required. Such a paper protector is realized by providing a first blank, comprised of a central panel, which is in contact with the contained object, inner panels, provided around the periphery of the central panel, which are set upright and surround the object, and first mid panels, which are folded outwardly from the extremities of the inner panels; a second blank, consisting of a central opening with approximately the same configuration as the above central panel, a second mid panel, which surrounds the periphery of that opening and is positioned either above or below the first mid panels above, and outer panels, which surround the exterior of the above inner panels and are folded down from the extremities of the second mid panel; and a space within the inner and outer panels having a width approximately equivalent to that of both the first and second mid panels.

It is possible to manufacture a paper protector such as this by using an apparatus consisting of a lower mold, which is provided with a frame section having a support surface which commonly supports the first and second mid panels of the above two blanks, since the blanks are fitted one on top of the other, and an inner chamber within this frame section into which the central panel of one of the blanks is pressed; a central mold for the purpose of piercing the central opening of the other blank and holding the first and second mid panels stationary on the above support surface; and an upper mold, which has a peripheral rim for the purpose of forming and folding the outer panels of this blank, which protrude beyond the periphery of the central mold, around the external surfaces of the frame section and guide projections fitted into the lower surface of the above peripheral rim for the purpose of folding the gluing flaps provided on a portion of the blank in the direction of contact with the above outer panels approximately where the folds of the outer panels are located and bonding them.

The paper of this invention is any paper generally referred to as that made of vegetable fiber; however, it also includes that produced of synthetic resins, such as so-called resin paper or others, which do not cause any harm when incinerated or which are considered to pose no problems under normal handling conditions.

The invention will now be described in detail with reference to the accompanying drawings, wherein:

DESCRIPTION OF THE PREFERRED EMBODIMENTS

Figure 1:
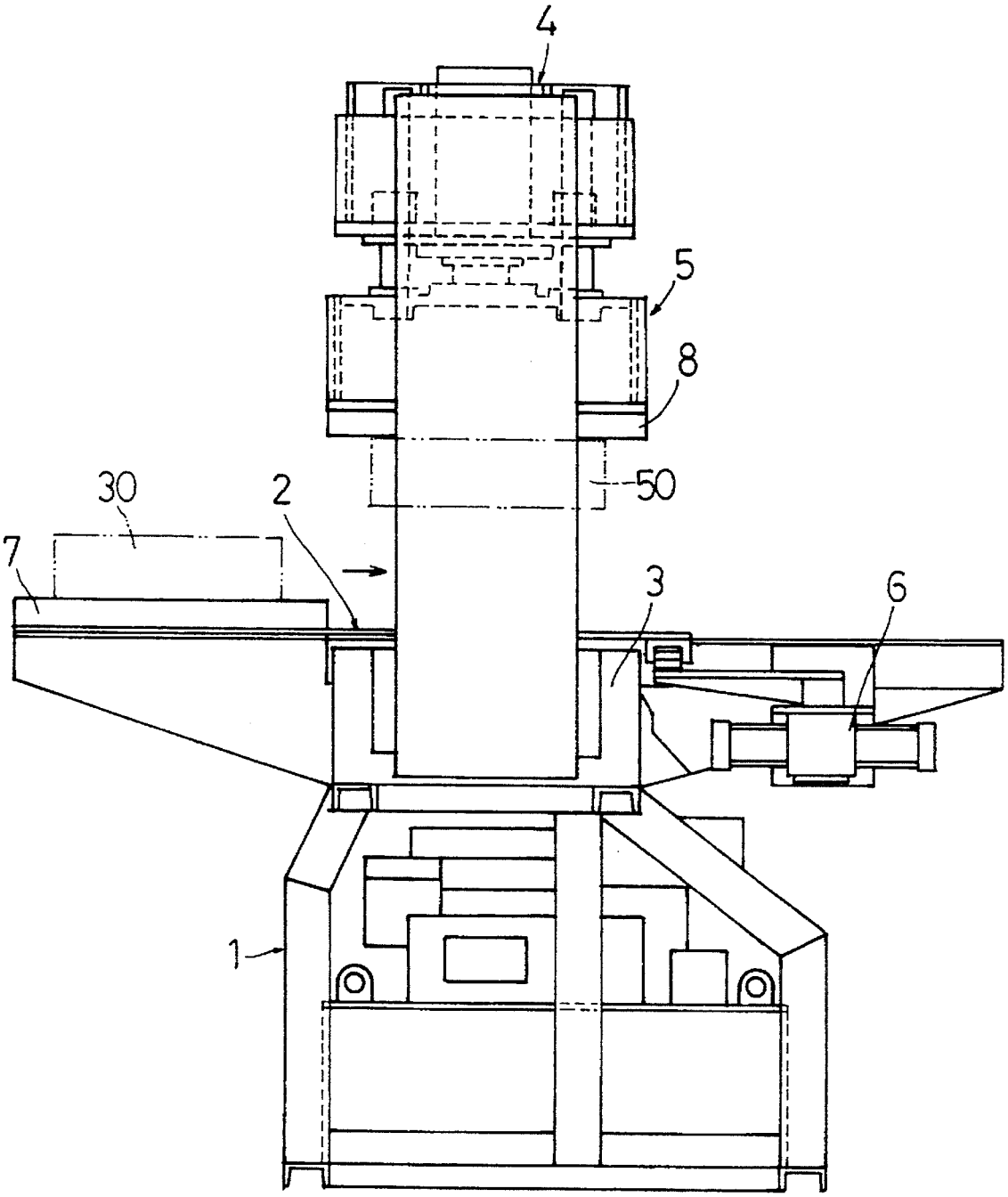
FIG. 1 is a side elevational view illustrating an example of the paper protector production apparatus pertaining to this invention.
Figure 2:
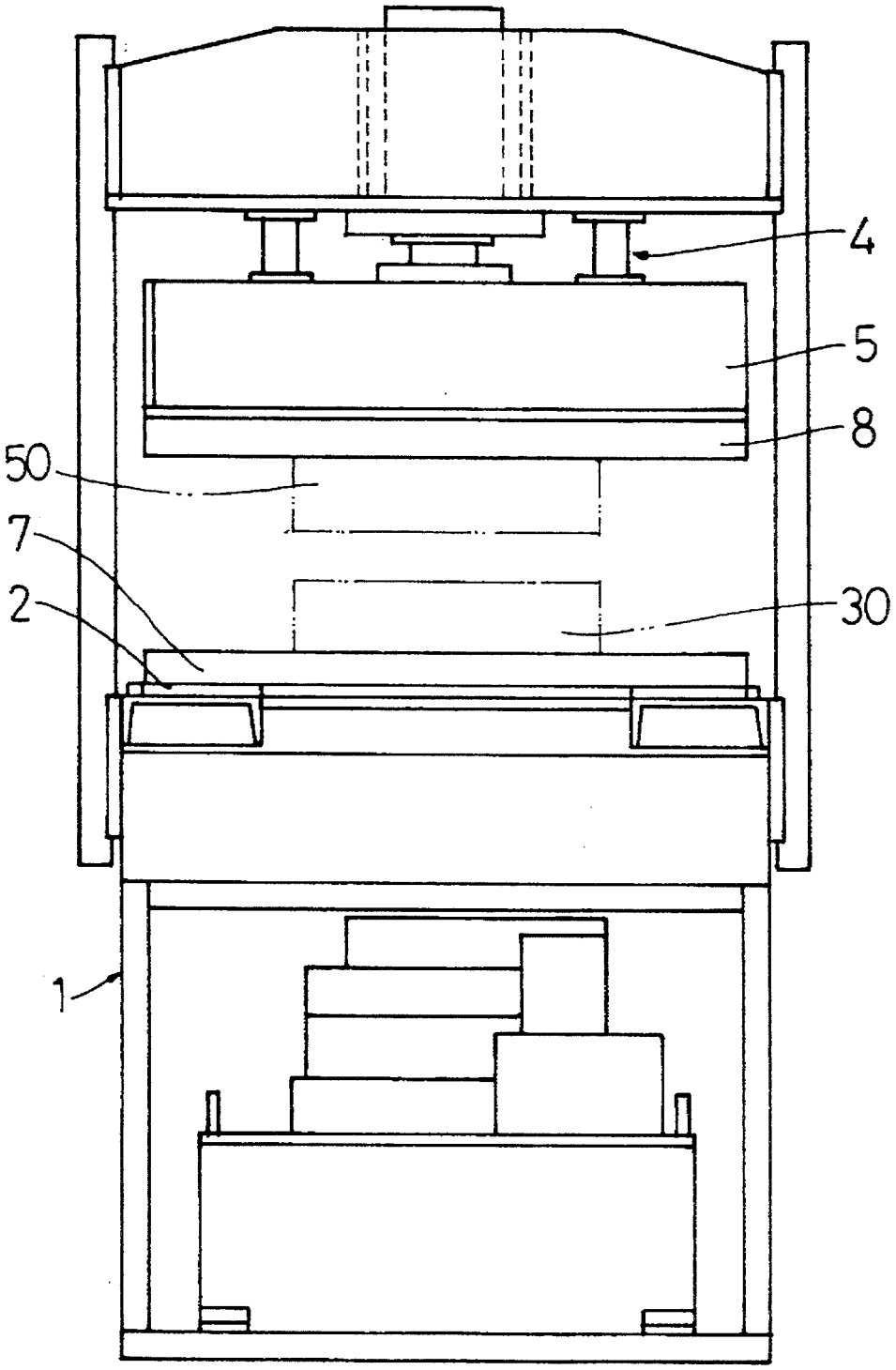
FIG. 2 is a front elevational view of the apparatus of FIG. 1.
Figure 3:
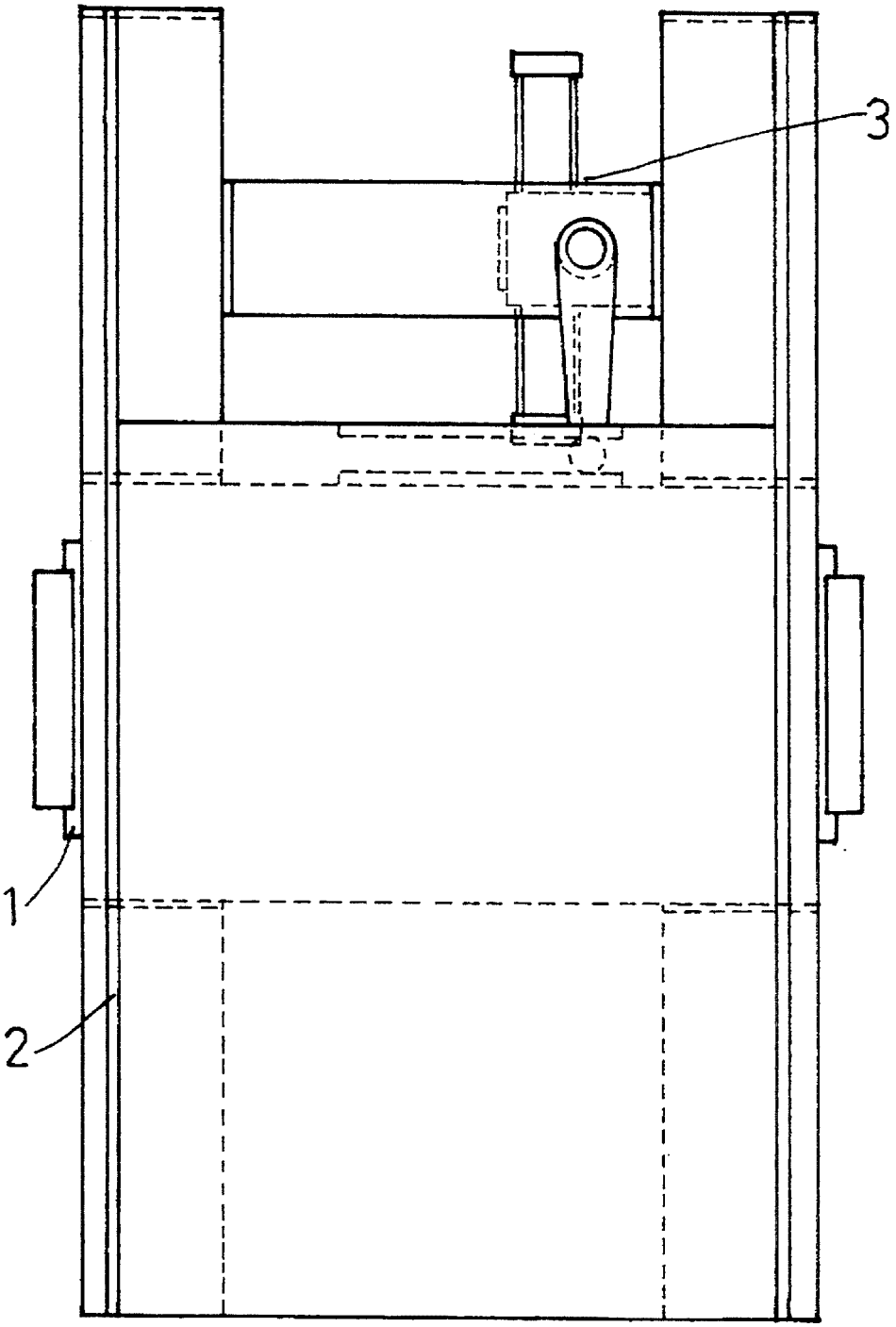
FIG. 3 is a top plan view of the apparatus of FIG. 1.

In the drawings FIGS. 1–3 illustrate actual examples of the apparatus pertaining to this invention. FIGS. 4–10 relate to actual example 1 while FIGS. 11–21 relate to actual example 2.

The apparatus that drives the metal mold apparatus as illustrated has a lower plate 3 with guide rails 2, which are generally horizontal, installed on a base 1, and an upper plate 5 that can move vertical because of the elevating mechanism 4 installed above the central work area; the lower plate 3 is capable of moving back and forth between the work area and the standby position because of a hydraulic mechanism 6, installed beside the guide rails.

The lower mold 30 is fitted to the upper surface of the lower plate through lower plate heater 7, and the upper mold 50 is fitted to the lower surface of the upper plate 5 through the upper plate heater 8. These heaters 7 and 8 are capable of applying heat selectively to the lower plate, the upper plate or both.

The paper protector illustrated in actual example 1 is formed with two blanks, 10 and 20.

Figure 4:
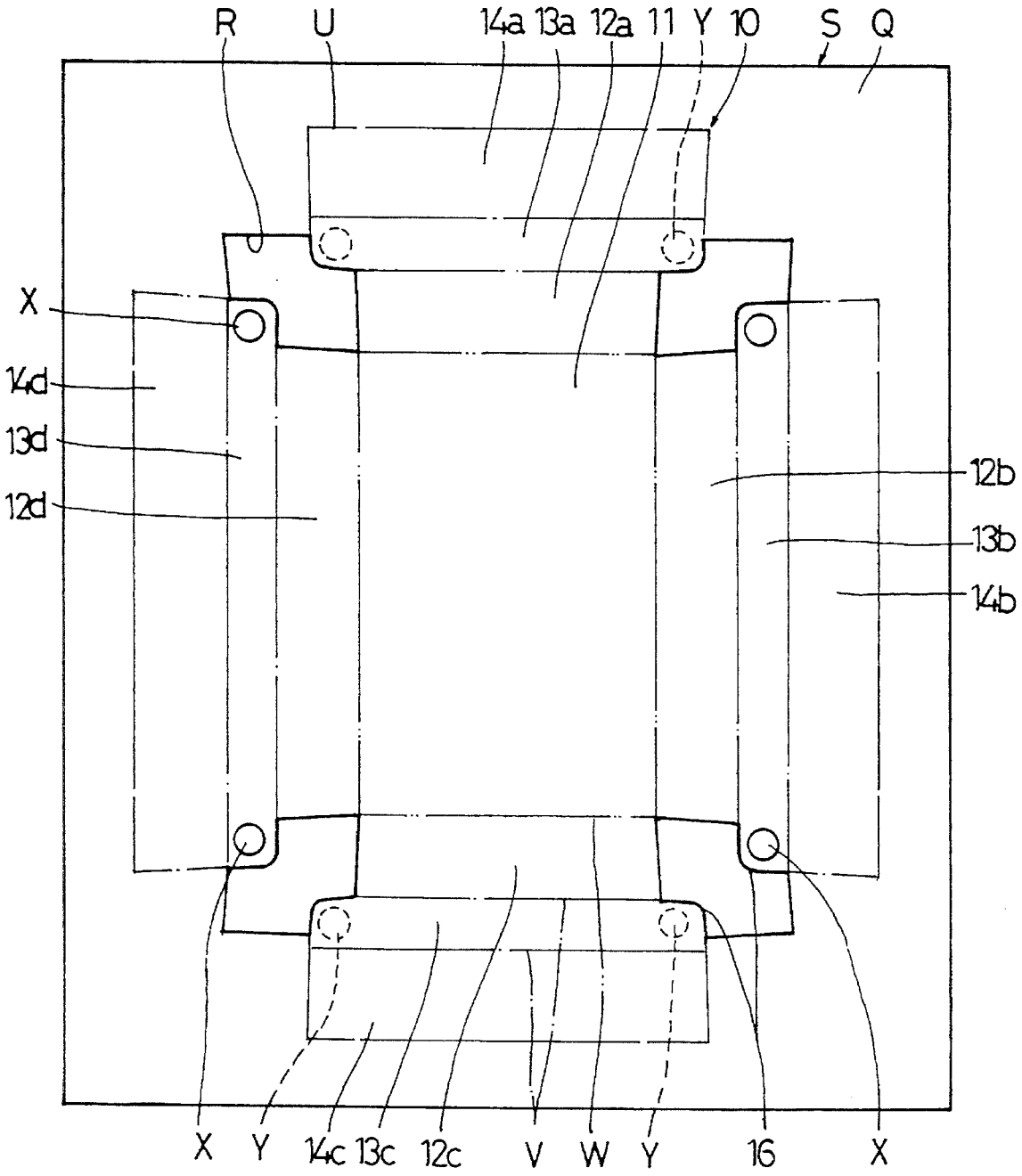
FIG. 4 is an expanded plain view of the first blank relating to example 1 of this invention.

The first blank 10, shown in FIG. 4, has a central panel 11 which is somewhat larger than the plane surface area of object M to be protected and of a similar configuration allowing the object to be accommodated; multiple inner panels 12*a*, 12*b* . . . which are provided in succession around the exterior of the central panel 11 and which have the necessary height to make it possible to form walls to surround the concavity 58, which receives the object; an equal number of mid panels (second mid panels) 13*a*, 13*b* . . . provided in succession along the outside edges of inner panels 12*a*, 12*b* . . . for the purpose of providing spaces 55 around the outside of the concavity that receives the object; and outer panels 14*a*, 14*b* . . . which are provided in succession along the outer edges of mid panels 13*a*, 13*b* . . . to surround the outer edges of inner panels 12*a*, 12*b* . . . at a fixed spacing.

The blanks are cut from patterns in sheets, but in the example 1, one blank 10 is handled without being detached from sheet material S and outer edge Q is used for mounting to the apparatus. However, any surplus portions that are neither a part of blank B nor of outer edge Q should be removed in advance. R indicates the portions to be removed. Furthermore, in FIG. 4, the fine line U indicates the stamped-out portions, the single-dot chain line V indicates the hump-fold portions and the double-dot chain line W indicates the trough-fold portions. These folded portions should be tooled in advance.

Furthermore, the primary blank 10 is glued so that the object received M can be secured appropriately without allowing the folded and formed portions to deform while in a free state; the locations for providing gluing flaps for that purpose and the sections to which they are bonded can be set at random.

As the means of gluing, in the case of actual example 1, a heat-sensitive adhesive is applied in advance to the outer surface of the primary blank 10. In this example, a heat-sensitive adhesive is applied over the entire outer surface of blank 10 before or after, it is punched out of sheet material S. A two-liquid type adhesive can also be used instead of heat-sensitive adhesive, in which case one of them is applied to the above adhesive application points. These points are indicated by X and Y.

The central panel 11 may be triangular, pentagonal or polygonal having more sides or other configurations, while the inner panels, etc., can be modified in accordance with that configuration; actual example 1, however, is explained by referring to a four-sided box configuration.

Figure 5:
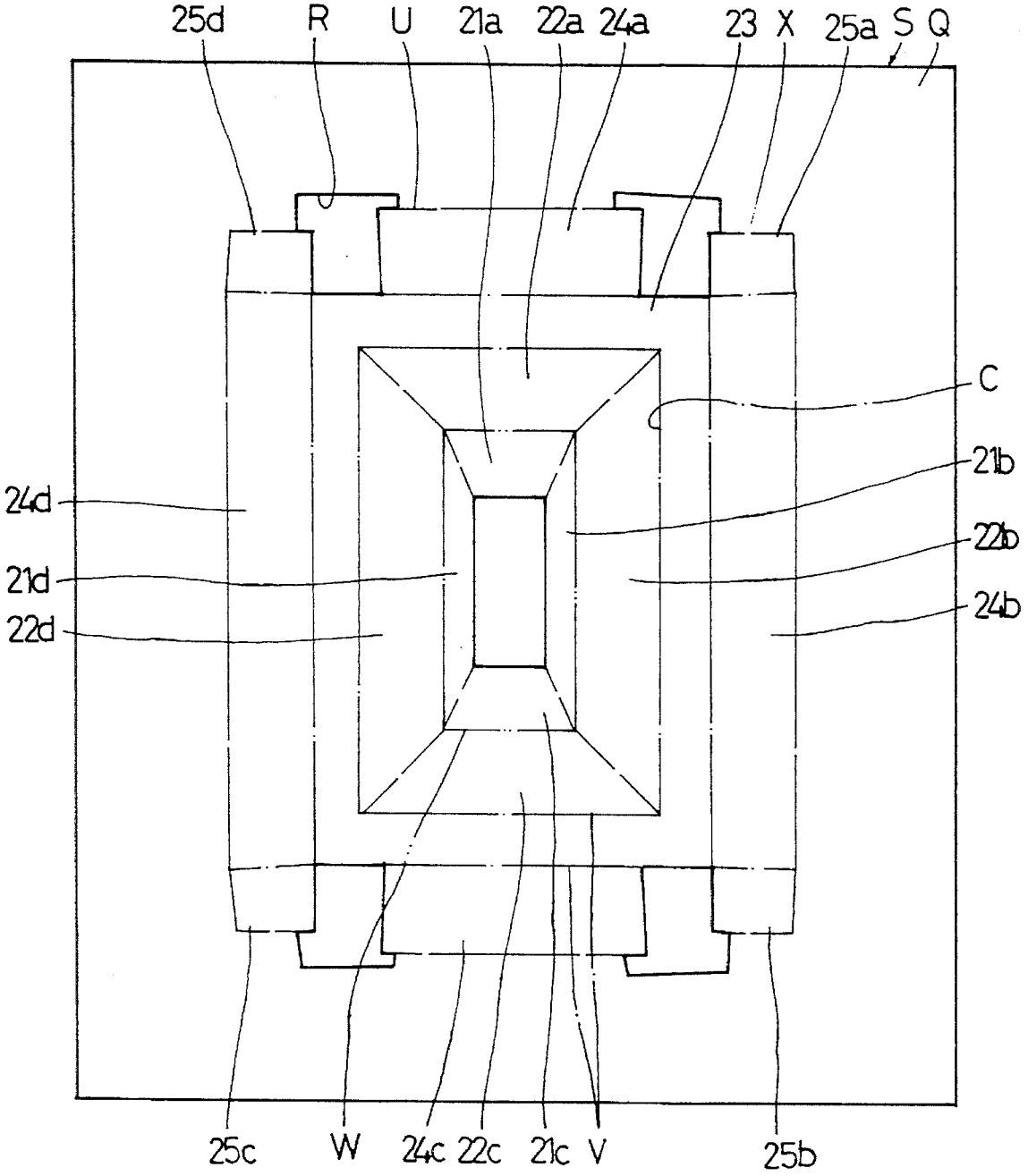
FIG. 5 is an expanded plan view of the second blank relating to example 1.
Figure 6:
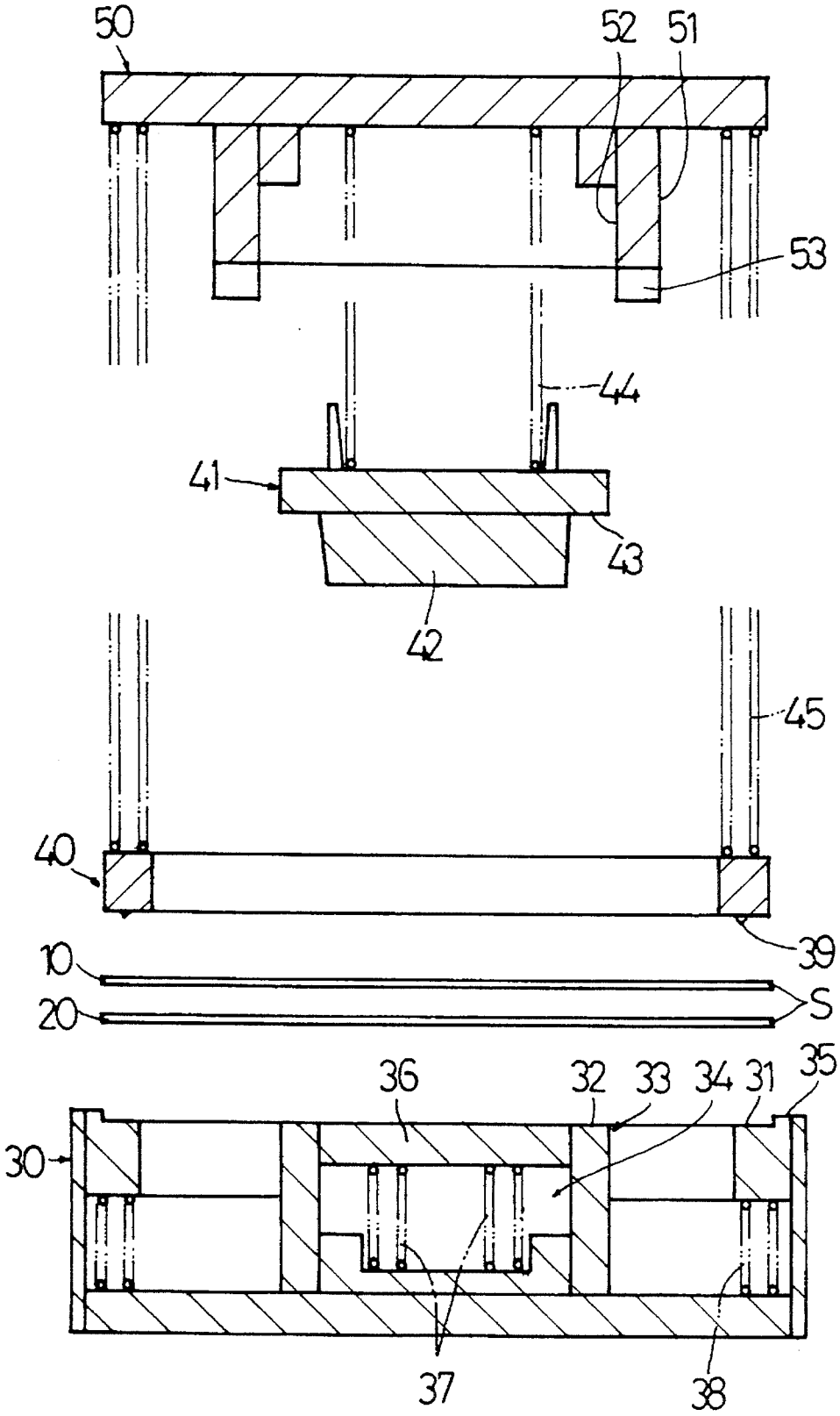
FIG. 6 is an exploded cross-sectional view of the metal mold apparatus of example 1 that forms the blanks.

The other blank, the secondary blank 20, is indicated in FIG. 5, and is positioned under the primary blank (FIG. 6). Moreover, it is provided with reinforcement sections that are large enough to allow them to receive the central panel 11 and inner panels 12*a*–12*b*, which rise up from its four sides; these reinforcement sections are made up of inner panel reinforcements 22*a*–22*d*, which come into contact with the inner panels 12*a*–12*d*, and central panel reinforcements 21*a*–21*d*, which are provided in succession along the inner edges of reinforcements 22*a*–22*d* and come into contact with the edges of the four sides of the central panel 11. The external circumference of the above reinforcement sections is surrounded by the rim-shaped mid panel reinforcement (second mid panel 23, which overlaps the mid panels 13*a*–13*d* of the primary blank 10.

Furthermore, the outer panel reinforcements 24*a*–24*d*, which overlap the lower sides of the outer panels 14*a*–14*d*, are formed in succession along the outer edges of the mid panel reinforcement 23 and gluing flaps 25*a*–25*d* to bond together the outer panel reinforcements 24*a*–24*d* are formed in the extremities of the reinforcements 24*b* and 24*d* after folding. Since other compositions can be the same as those of the primary blank 10, explanations are given invoking those symbols.

The makeup of the apparatus for producing a protector from such primary and secondary paper blanks 10 and 20 is as indicated below FIG. 6.

Lower Mold

The lower mold 30 is a component for receiving and supporting the above sheet material S and is provided with a rim-shaped material holder 31 for receiving the unused edge material Q around the periphery of the primary and secondary blanks 10, 20 and the frame 33, within which is provided a support surface 32 in a position corresponding to the external configuration of the central panel 11 of the protector. It is also possible to remove the blanks 10 and 20 from the sheet material S in advance, retain them by means of suction disks, and set them into the lower mold, in which case the material holder 31 is not necessary.

The support surface 32 is approximately the same height as the material holder 31 and the width of its surface is approximately equivalent to that of the mid panels 13*a*–13*d* of the primary blank 10 and mid panel reinforcement 23 of the secondary blank 20. The height of the interior sides of the frame 33 is approximately equivalent to that of the inner panels 12*a*–12*d* and inner panel reinforcements 22*a*–22*d* of the primary and secondary blanks 10 and 20, while the exterior sides of the frame 33 are set at a height greater than that of the outer panels 14*a*–14*d* and outer panel reinforcements 24*a*–24*d*.

The interior sides of the lower mold surrounded by the frame 33 make up the central chamber 34, within which the central panel 11 of the primary blank 10 is pressed. Consequently, the configuration of its bottom surface corresponds approximately to that of the cavity, which accommodates the object within the protector. When words such as "corresponds" or "equivalent" are used for this invention, they mean approximately corresponding for equivalent taking into consideration the thickness of sheet material S. The inner surfaces of the above central chamber 34 are sloped to facilitate removal of the protector after production.

The edge retainer 40 is used to hold down and retain the unused edge material Q in the in lower mold 30 and, together with sheet material S, is held stationary within the projecting rim 35 along the outer extremity of the material holder 31. The panel holder 36, which holds the central panel 11, is provided within the interior surface of the support surface 32. This panel holder 36 can be restored to its upper fixed position within the central chamber 34 by means of thrust springs 37, which push up the central panel of the paper protector that has been formed thereby facilitating its removal. The support springs 38 for the material holder 31 and the retainers 39 pierce and hold the blanks in place.

Central Mold

The central mold 41 is equipped with a downward-facing projection 42 for the purpose of pressing the central panel 11 of the primary blank 10 down within the central chamber 34 of lower mold 30, while making the inner panels 12*a*–12*d* located along the periphery of the central panel upright, and folding the reinforcements of the secondary blank; and overhead 43, which projects out in all directions above the upper surface of the projection 42 and restrains the mid panels 13*a*–13*d* of the primary blank 10 and the mid panel reinforcement 23 of the secondary blank 20 on the above frame 33, folding them outwardly. The outer surfaces of the projection 42 are provided with a slope and the exterior of the overhead 43 is smaller than that of the frame 33 of the lower mold. This central mold 41 is suspended from the upper mold by means of springs 44; moreover, it is also possible to similarly suspend the above edge retainer 40 from the upper mold by using springs 45. However, the edge retainer 40 is designed to retain the blanks 10 and 20 first.

Upper Mold

The upper mold 50 has a downward-facing peripheral rim 51, fits over the outer surface of the frame 33 of the lower mold 30 for the purpose of forming the outer panels 14*a*–14*d* of the primary blank 10 and the outer panel reinforcements 24*a*–24*d* of the secondary blank 20 in conformance with the configuration of the frame 33. The inner surface 52 of the peripheral rim 51 is provided with an appropriate slope in order to fold down the outer panels 14*a*–14*d* the outer panel reinforcements 24*a*–24*d* and extract them afterward.

Figure 7:
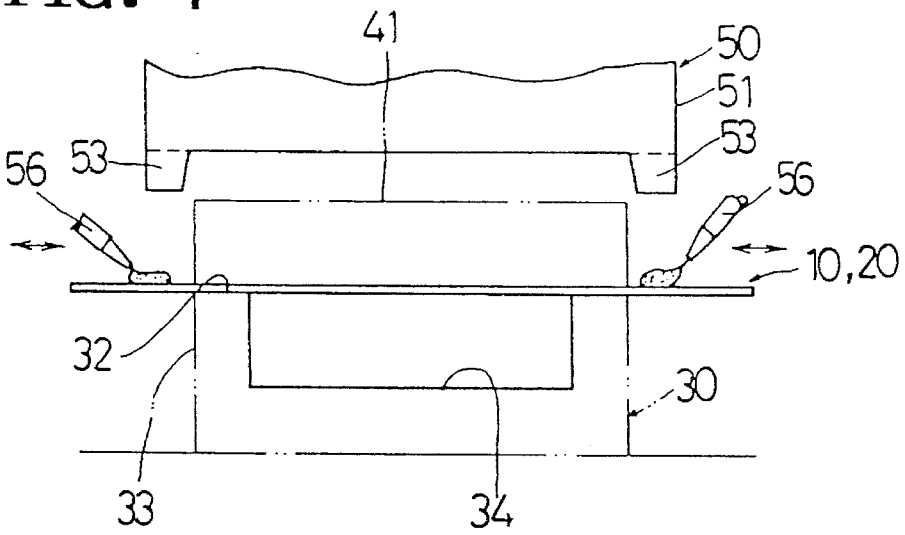
FIG. 7 is a schematic cross-sectional explanatory view of the gluing tab folding process.
Figure 8:
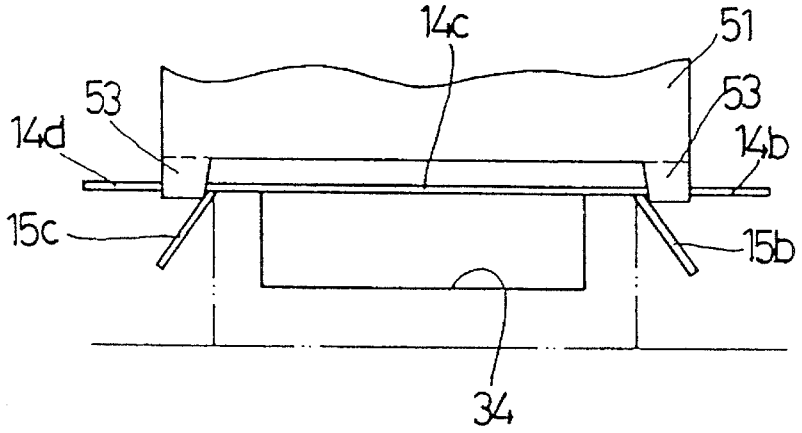
FIG. 8 is a view similar to FIG. 7 showing a further step.
Figure 9:
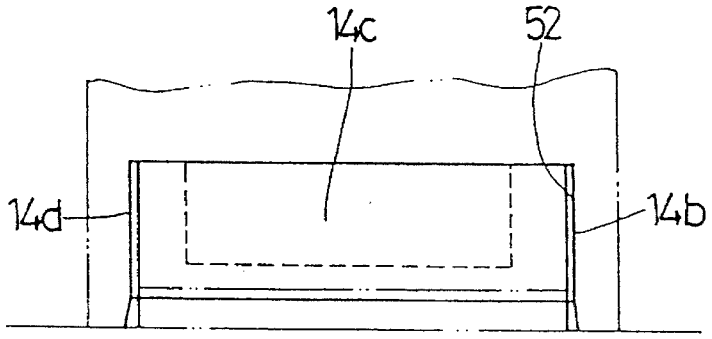
FIG. 9 is a similar to FIG. 8 showing a further step.
Figure 10:
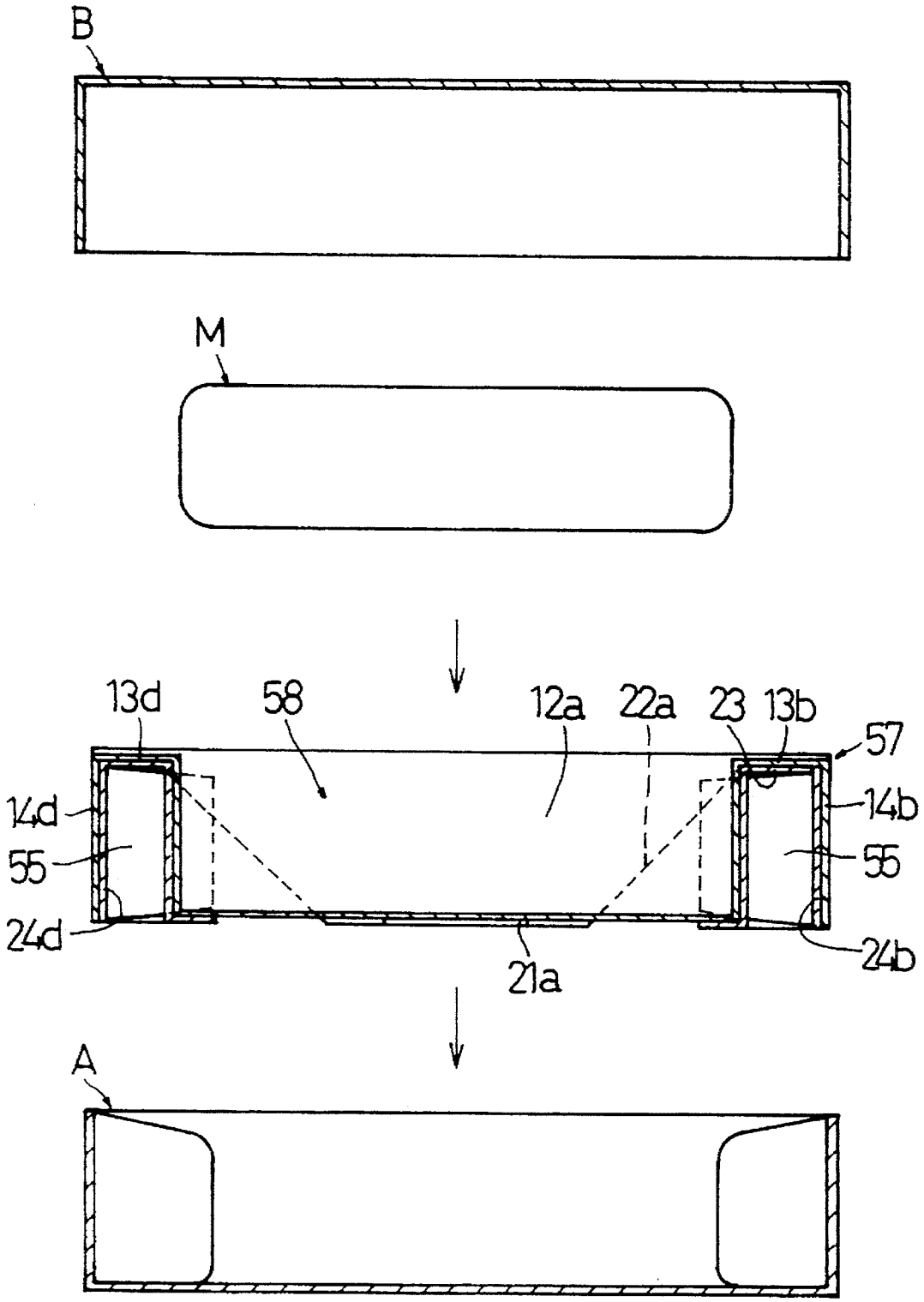
FIG. 10 is an exploded cross-sectional view illustrating the paper protector of example 1 in use.

Downward projecting guide projections 53 are provided at the lower extremity of the peripheral rim 51 in a location accommodating the gluing flaps 15*a*–15*d* and 24*a*–24*d* for the purpose of folding said gluing flaps 15*a*–15*d* and 24*a*–24*d* prior to folding the outer panels and their reinforcements 14*a*–14*b* and 24*a*–24*d* refer to FIGS. 7–9.

The above lower mold 30 is installed in the upper surface of the above lower plate 3 through the heater 7 and the central mold 41 and upper mold 50 are both installed at the lower surface of the upper plate 5 through the heater 8.

Production Processes

The Setting Process

Sheet material S containing the primary blank 10 and sheet material S containing the secondary blank 20, which are stamped out in a prescribed configuration and which include fold lines, are placed onto the material holder 31 of the lower mold 30 and the edge material Q is held firmly in place by the edge retainer 40. At this time, the central panel 11 is positioned on the panel holder 36.

Concavity Formation Process

The upper mold 50 descends over the central panel 11 of the primary blank 10 on the support surface 32 and the central panel 11 and the reinforcements of the secondary blank 20 become restrained between the projection 42 of the central mold 41 and the lower panel holder 36; the central panel 11 is then pressed into the central chamber 34 of the lower mold 30. Simultaneously, the four inner panels 12*a*–12*d*, together with the inner panel reinforcements 22*a*–22*d*, rise upright along the inner surface of frame 33; furthermore, the mid panels 13*a*–13*d* slip under the mid panel reinforcement 23, are folded outwardly at their border with inner panels 12*a*–12*d* and are restrained between the support surface 32 of the lower mold 30 and the overhead 43 of the upper mold 41.

At this stage, the concavity 58 that receives the object is formed and, in addition, both blanks 10 and 20 are separated from edge material Q at the stamp-out portion U.

Outer Panel Folding Process

From the above state of conditions, the upper mold 50 continues to descend and is eventually fitted within the lower mold 30; the outer panels 14*a*–14*d* and the outer panel reinforcements 24*a*–24*d*, which project outwardly, are folded downward along the fold lines at their border with the mid panels 13*a*–13*d* and their reinforcement 23; thereupon, the gluing flaps 15*a*–15*d* and 25*a*–25*d* are bonded and, in this manner, a paper protector with fixed spaces 55 within the outer panels 12*a*–12*d* is formed FIG. 7.

With this process, the gluing flaps 15*a*–15*d* and 25*a*–25*d* are first folded within the outer panels 14*a*–14*d* and their reinforcements 24*a*–24*d*. In this procedure, since the projections 53 at the lower extremity of the upper mold first fold the gluing flaps 15*a*–15*d* and 25*a*–25*d* downwardly, after which the outer panels 14*a*–14*d* and their reinforcements 24*a*–24*d* are folded by the lower extremity of the projections of the upper mold, the gluing flaps (15*a*–15*d* and 25*a*–25*d* which had been folded first, can be inserted within the outer panels 14*a*–14*d*, 24*a*–24*d* FIG. 7–FIG. 9.

These gluing flaps 15*a*–15*d* and 25*a*–25*d* are bonded to outer panels 14*a*–14*d* and their reinforcements 24*a*–24*d* through the application of heat when the gluing flaps and outer panels are under pressure. Retractable glue application nozzles 56 are installed and glue can be applied prior to the insertion of the gluing flaps.

The paper protector in completed form and bonded at the gluing flaps is forced up from the lower panel holder 36 by the action of the springs as the upper mold 50 and central mold 41 rise and separate from the lower mold 30. Consequently, the product can be easily removed from the lower mold 30 and efficient operations can be maintained.

The paper protector 57 produced in this manner protects object M accommodated in the storage concavity 58 due to the spaces 55 formed by mid panels 13*a*–13*d* between the inner panels 12*a*–12*d* and outer panels 14*a*–14*d*. This protector is further packaged and dressed by outer packaging made up of outer box A, lid B, etc.

Figure 11:
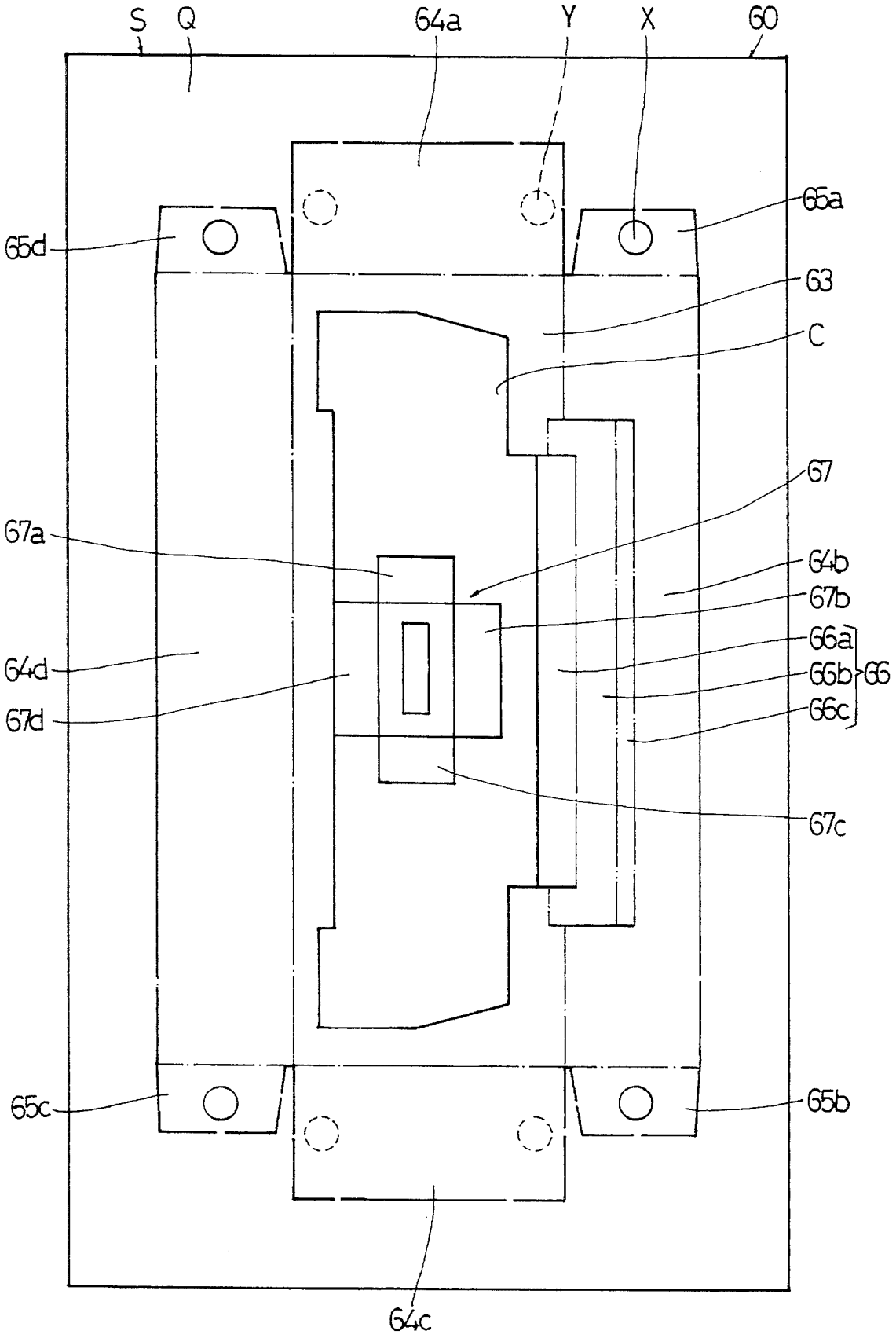
FIG. 11 is an expanded plan view of the first blank relating to example 2 of this invention.

The following is an explanation of actual example 2 indicated in the diagrams beginning with FIG. 11. The primary blank 60 indicated in FIG. 11 forms the outer surface of the paper protector and the concavity in which the item is accommodated is formed by a secondary blank 70 indicated in FIG. 12. Therefore, since the secondary blank 70 of the example 2 corresponds to one of the blanks noted above within the scope of this invention and the primary blank 60 corresponds to the other, the composition of this actual example is different from that of actual example 1, in which the concavity 58 is formed by the primary blank 10.

The primary blank 60 of the example 2 consists of central cavity C, stamped out in a configuration large enough to receive the contained object M; a rim-shaped front panel 63 second mid panel, which surrounds central cavity C; and outer panels 64*a*, 64*d*, 64*c*, 64*d* installed so that they can be folded outwardly from the four sides of front panel 63. The above front panel 63 should be referred to as a mid panel since it is positioned between the inner and outer panels.

In order to maintain the three-dimensional configuration and avoid deformation in the folded state, gluing flaps 65*a*–65*d* are provided at both extremities of the long outer panels 64*b* and 64*d* of the primary blank 60 and a means of bonding with the above-mentioned heat-sensitive adhesive, etc., is provided between them and the outer panels 64*a* and 64*c* which they contact. Though the glue points are indicated by X and Y, they can be situated anywhere. In the case of actual example 2, a means of gluing virtually the entire surface of the front panel 63 of the primary blank 60 has been provided.

Figure 21:
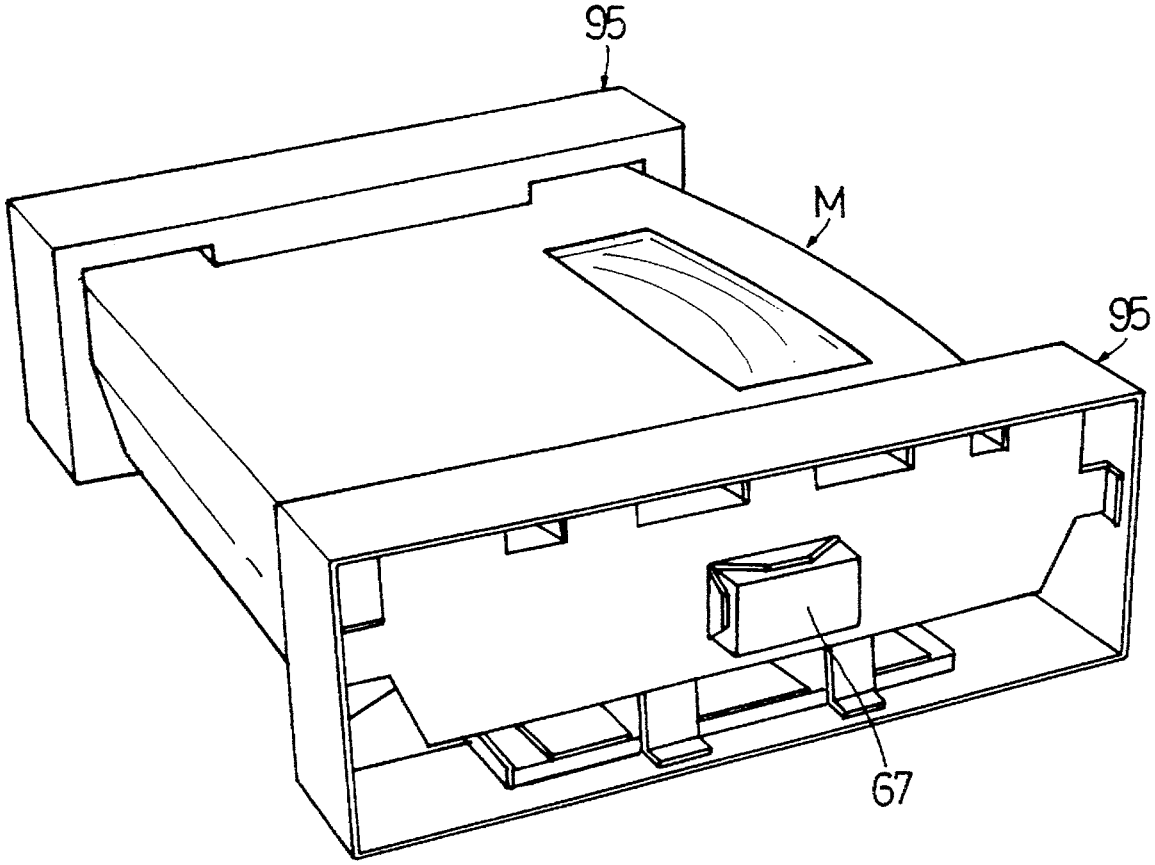
FIG. 21 is a perspective view of the above paper protector in use.

The central opening C of the primary blank 60 has a complex configuration; however, this allows it correspond to the configuration of the sides of the contained object M, indicated in FIG. 21, and on one side of opening C, in particular, a folded portion 66 is provided as a concavity to receive accessories, etc., to be accommodated together with object M. 66*a* indicates the upper level section, which is positioned lower than the front panel 63, and 66*b* is the wall section, which is folded downward from Tthere; 66*c* is the lower level section, which is folded outwardly from the bottom of the wall section 66*b*.

Figure 12:
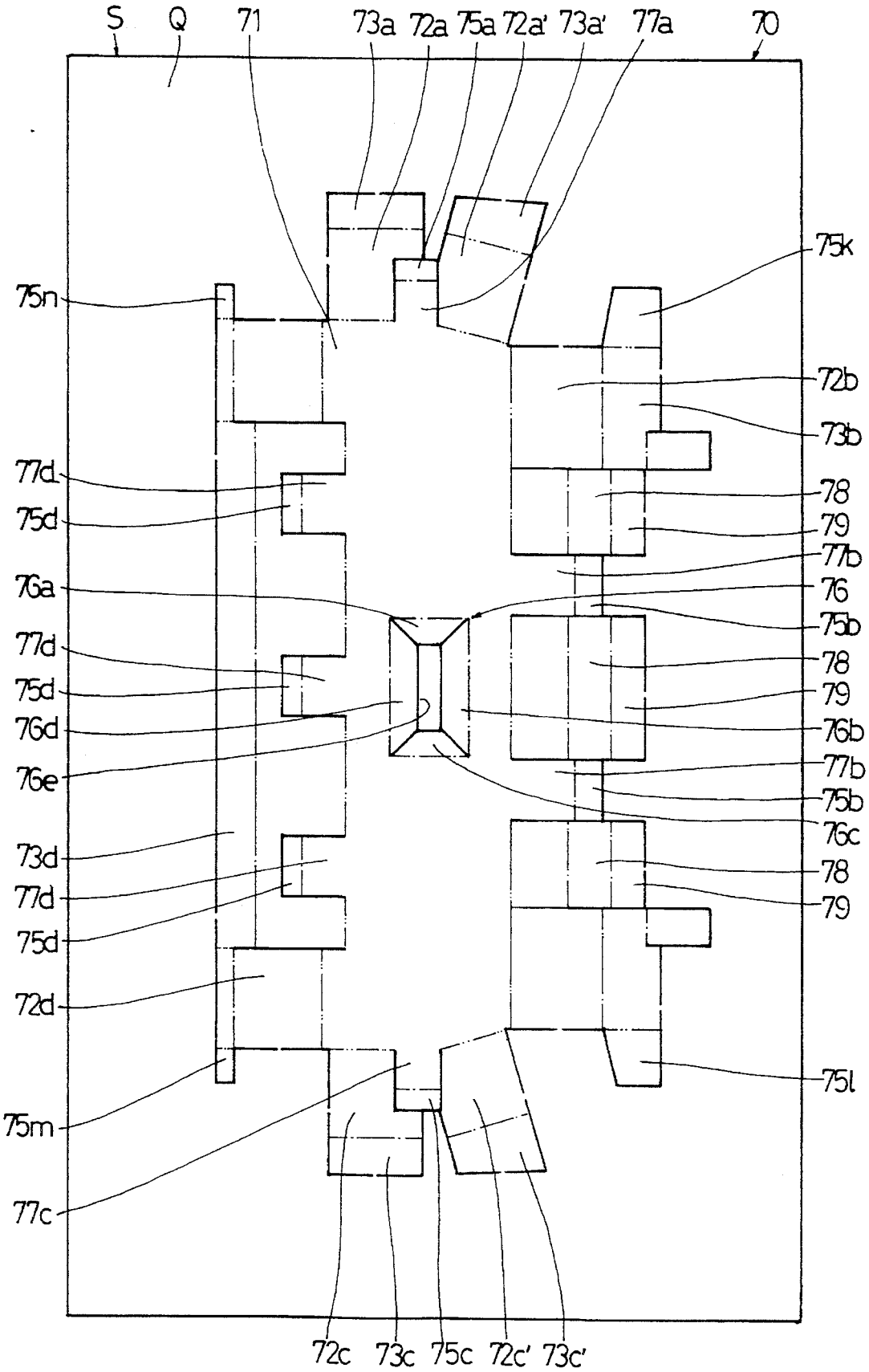
FIG. 12 is an expanded plan view of the second blank relating to example 2.

The secondary blank 70 of example 2 illustrated in FIG. 12 consists of a central panel 71, which is located at the center of the blank and which contacts the contained object M; inner panels 72*a*–72*d*, which rise upright to surround the central panel 71; and first mid panels 73*a*–73*d*, which are folded outwardly from the extremities of the inner panels 72*a*–72*d*. Folded inner panels 72*a*' and 72*c*' are provided in the inner panels 72*a* and 72*c* and folded mid panels 73*a*' and 73*c*' are provided in the first mid panels 73*a* and 73*c*, to bring them into correspondence with the folded sections of central opening C.

The first mid panels 73*a*–73*d* are the portion that overlaps the front panel 63 of the primary blank 60 from the bottom and, since these are important overlapping sections of the primary and secondary blanks 60 and 70, the first mid panels 73*a*–73*d* act as gluing flaps in the case of example 2.

The central panel 71 has a rectangular opening 76 for the purpose of forming a concavity where required and concavity retainers 76*a*–76*d* are provided in this opening 76; concavity 67, made up of separate parts, fits within this and is bonded. The blank for this cavity 67 can be formed by using the central opening C of the primary blank 60; it is provided in a configuration such as that indicated in FIG. 11 and is made up of side sections 67*a*–67*d*, which rise upright in a central rectangular configuration.

Furthermore, spacers 77*a*–77*d* are provided on all four sides between the central panel 71 and inner panels 72*a*–72*d* in order to maintain a fixed spacing of the outer panels 64*a*–64*d*; of these, the various spacers 77*b* and 77*d* along the sides are provided with gluing flaps 75*a*–75*d* at their extremities.

Supports 78, which support the upper level section 66*a* of the primary blank 60 from the bottom, are formed in close proximity to the spacer 77*b* sections; each support 78 is bonded to the wall section 66*b* of the bottom of the upper level section by means of gluing flaps 79. Furthermore, the upper surfaces of the first mid panels 73*b* and 73*d* themselves become gluing flaps and gluing flaps 75*k*, 75*l*, 75*m* and 75*n* are provided at their extremities in a lateral direction.

The entire surfaces of the primary and secondary blanks can be bonded when added strength is needed, while spot bonding is satisfactory when there is no special strength requirement. For example, the surface of the first mid panels 73*b* and 73*d* and the lower surface of the second mid panel 63 in FIG. 11 can be entirely bonded.

The composition of the metal mold apparatus used to produce paper protectors from the above blanks 60 and 70 is as indicated in FIGS. 13–18. In this explanation, the metal mold apparatus shall be treated as a structure that retains the material as sheets, though, of course, it is also possible to remove the edge material Q in advance and transfer the blanks 60 and 70 into the mold by retaining them with suction disks, etc.

Lower Mold

The lower mold 80 is a component for supporting the sheet material S, as is the lower mold 30 of actual example 1, since its fundamental composition has much in common with the lower mold 30, the same symbols shall be used and the explanation shall not be repeated.

The lower mold 80 of example 2 is characterized by having a projection 81 in the center of the frame 33 as well as numerous grooves 82*a* . . . provided in the wall surface of the frame 33.

Figure 16:
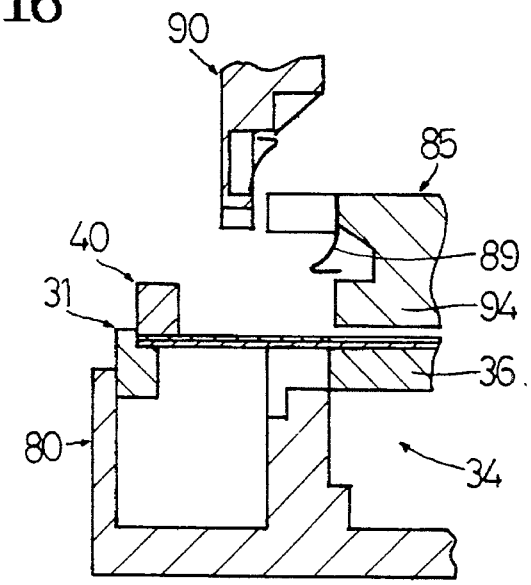
FIG. 16 is a cross-sectional view of folding process details.
Figure 17:
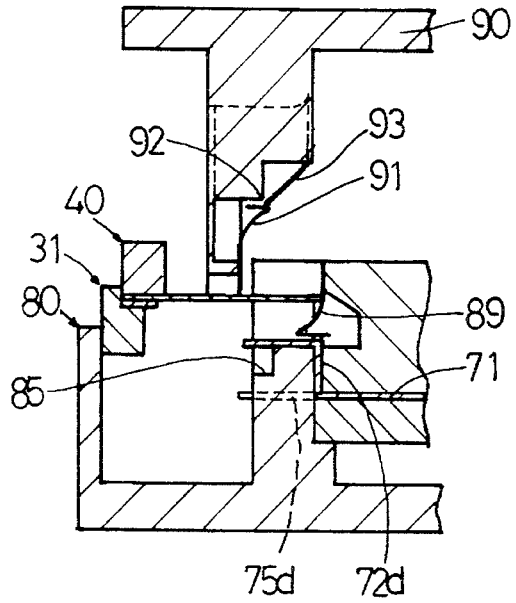
FIG. 17 is a view similar to FIG. 16 showing of same details of a further step.
Figure 18:
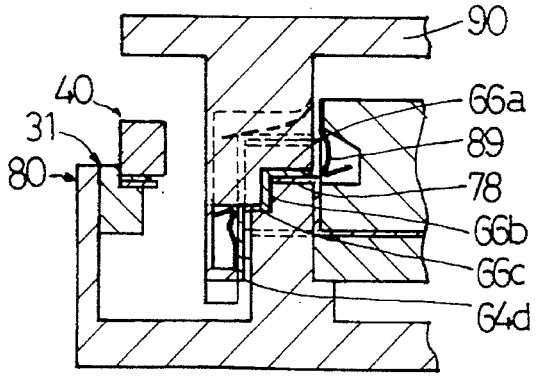
FIG. 18 is a view similar to FIG. 17 of details of a further step.

In order to form an opening 76 in the center of the secondary blank, the centrally positioned projection 81 pierces the central hole 76*e* of the opening 76 and is inserted into the guide hole 87 of the central mold 85. 83 is a hole formed in the panel holder 36, which forms the opening 76. Plurality of grooves 82*a* . . . are formed in locations corresponding to the spacers 77*a*–77*d* of the secondary blank 70 in order to allow the central panel 71 to descend to a fixed position without bending the spacers 77*a*–77*d* FIGS. 13–14. FIGS. 16–18 are lateral cross-sectional views of the central section.

Central Mold

Since the central mold 85 satisfies a function similar to that of the central mold of actual example 1, only an explanation of the differences will be given, namely, that it has a guide projection 86 for the purpose of forming an opening 76. This guide projection 86 has a guide hole 87 at its center, as indicated above; it forces the concavity 67 and its retainers 76*a*–76*d* down into the lower mold 80 and has a lower surface 88 to carry out any necessary folding.

Furthermore, the central mold 85 is provided with inwardly retractable panel springs 89 over the entire length of the support 78 of the secondary blank 70 for the purpose of restraining upper level section 66*a*, etc. including support 78, in a fixed position refer to FIG. 16.

Upper Mold

The symbols of example 1 apply as well to the upper mold 90 since it has fundamentally the same composition. That is, the upper mold 90 has a downward-facing peripheral rim 51 that fits within the frame 33 of the lower mold, and it is a component which produces the outer configuration of the protector primarily by means of the peripheral rim 51.

The upper mold 90 is characterized by having a composition which works in union with the leaf springs 89 to stretch out the support 78 and the stepped construction of its lower section. For that purpose, leaf springs 91, are first used to force wall section 66*b* of the primary blank 60 toward the inside; the convex stepped section 92, which thereupon forces the wall section 66*b* into the concave stepped section 84 of the lower mold; and thrust springs 93, which force the front panel 63 to both the right and left of this fold section 66 against the support surface 32 of the lower mold 80.

Production Processes

Setting Process

Figure 13:
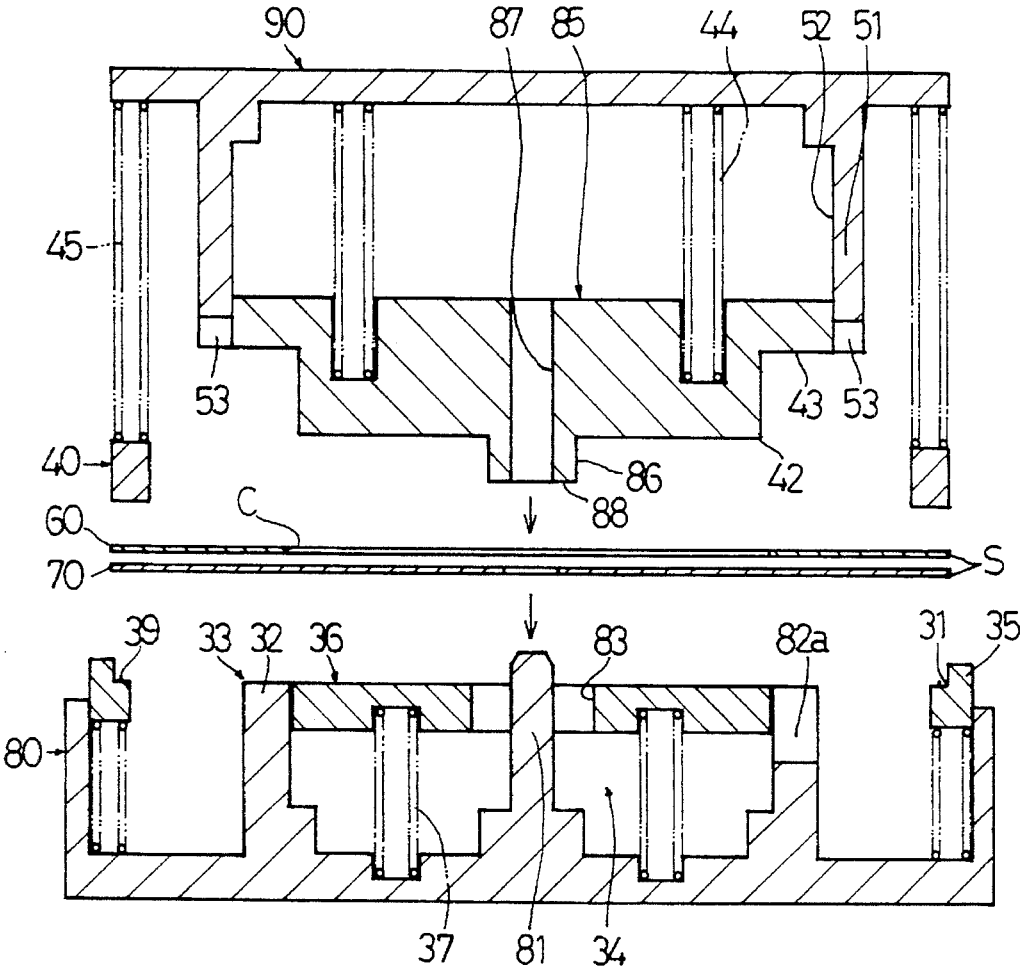
FIG. 13 is a cross-sectional view of the metal mold apparatus of example 2 is the open position that forms the blanks.

A secondary blank 70 is positioned under the above primary blank 60; edge material Q is placed on the material holder 31 of the lower mold 80 and is set so that the front panel 63 surrounding the central opening C is positioned over the support surface 32 FIG. 13.

Central Mold Lowering Process

Figure 14:
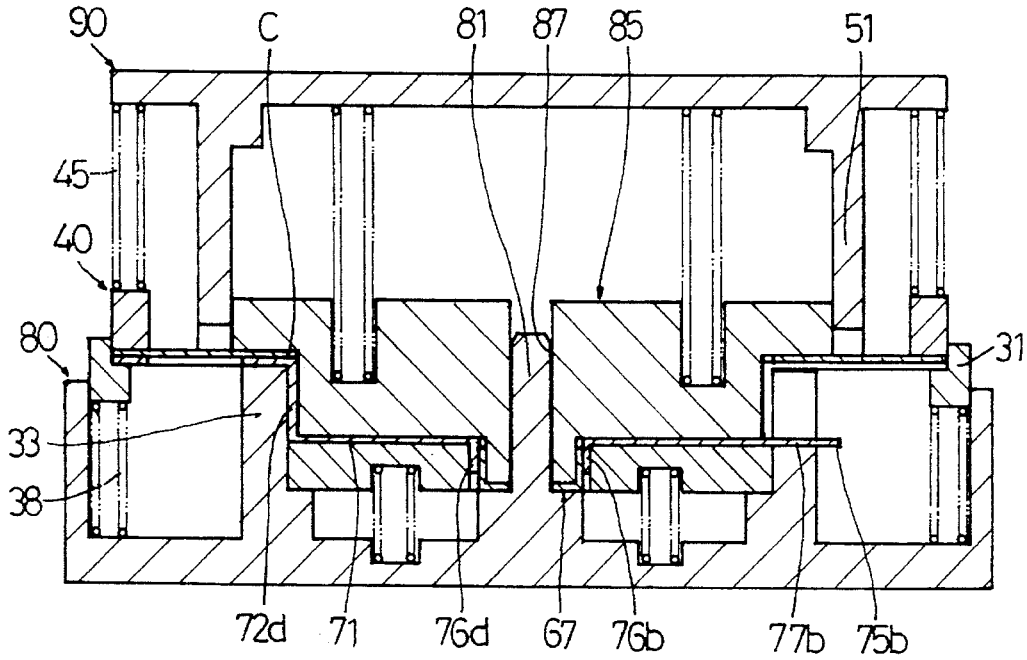
FIG. 14 is a view similar to FIG. 13 showing a further step of the blank folding process of the metal mold apparatus.
Figure 15:
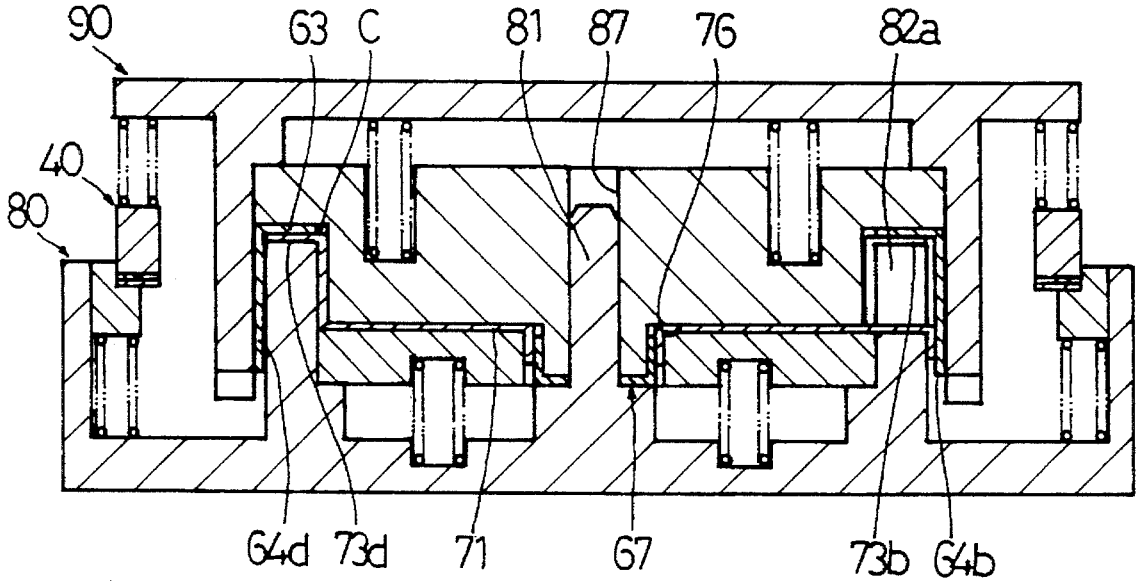
FIG. 15 is a view similar to FIG. 14 illustrating a further step of the same process.

When the central mold 85 is lowered by the descent of the upper plate, its central projection 42 pierces through the central opening C of the primary blank 60 and, while holding the front panel 71 of the secondary blank 70 down together with the panel holder 36, forces it within the central chamber 34 FIG. 14. At this time, the supporter 78 of the secondary blank 70 is restrained on the top of the support surface 32 and, in addition, spacers 77*a* and 77*b* are also forced down to the prescribed position.

Upper Mold Lowering Process

The upper plate descends further to the point at which the upper mold 90 fits within the lower mold 80. At this point, since the projections 53 at the lower extremities of each of the corners of the peripheral rim 51 first fold the gluing flaps 65*a*–65*d* of the primary blank 60, the procedure of their first being folded within the outer panels is the same as in the case of the previously-described actual example 1.

At this stage, the folded section 66 is formed when the convex stepped section 92, which forms the folded section 66, presses the wall section 66*b* and the lower stepped section 66*c* of the outer panel 64*b* into the concave stepped section 85 thrust springs 93 restrain the front panel 63 against the support surface 32 so that this panel 63 is not dragged into this complex formation FIG. 18.

Meanwhile, the concavity retainers 76*a*–76*d* in the central panel 71 of the secondary blank 70 are raised and formed when the central mold 85 is lowered. It is, therefore, possible to raise the sides 67*a*–67*d* upright, bring them into contact with the cavity retainers 76*a*–76*d* and simultaneously form the concavity by setting the concavity segments 67, which are formed by being punched out separately using primary blank 60, onto the central projection 81 of the lower mold.

Figure 19:
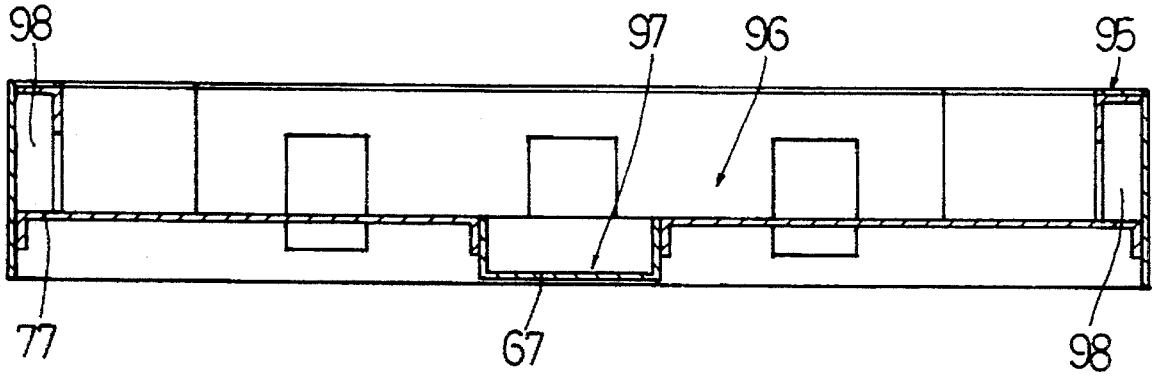
FIG. 19 is a longitudinal cross-sectional view of the paper protector of example 2.
Figure 20:
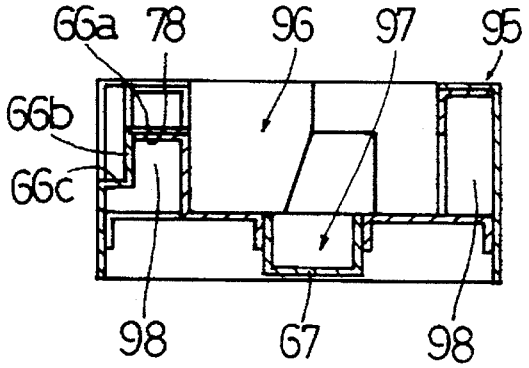
FIG. 20 is a lateral cross-sectional view of the paper protectors of example 2.

The paper protector 95 of actual example 2 produced in this manner has a structure such as the one illustrated in FIGS. 19–20.

That is, through the formation of the concavity 96, which has having the configuration of the central opening C at its center, the formation of the second concavity 97 where required on the central panel, the formation of spaces 98 between the inner panels 72*a*–72*d* and outer panels 64*a*–64*d* and the reinforcement of these spaces 98 by spacers 77*a*–77*d*, it becomes possible to protect the contained object M from external forces.

FIG. 21 illustrates a paper protector 95 in use in accordance with example 2. As can be clearly seen from the illustration, object M has been furnished on both the right and left with a pair of protectors 95 having symmetrical central openings C, making it possible to use this as a configuration for retaining contained object M. The protector 95 of example 2 can, of course, also be modified so that it can be used singly for the protection of the contained objects.

According to this invention, it is possible to obtain paper protectors that have a multiple structure capable of accommodating electronic apparatuses, precision equipment and other products and protect them from shock as resinous protectors do, by folding, tooling, bonding or otherwise processing multiple sheets of paper. Since this paper protector is made up of multiple blanks, as indicated above, the structure is multi-layered and sturdy and, since reinforcing projections are provided between the inner and outer surfaces, it is possible to satisfactorily protect even large items. Moreover, since it is possible to form irregular shapes, such as concavities 58, to accommodate the external configurations of objects, it is effectual in that it can accommodate a wide variety of such objects.

The paper protector according to this invention exhibits a number of outstanding characteristics. It lends itself particularly well to surface printing since paper in sheet form is used. It is also possible to obtain the degree of strength required by changing the material, thickness, etc., appropriate to the different purposes and the items to be accommodated. Packaging operations are simplified due to the uniformity that possible to be realized and it is also suitable for automation. Being a paper product, it can also be reused and, in addition, recycled paper material can also be used. Furthermore, if incinerated, it does not generate noxious gases as resins do.

I claim:

1. A multiple structure paper protector including at least two paper blanks forming inner and outer surfaces of the protector and assembled as a three-dimensional body, comprising:

a first blank having a rectangular central bottom panel for supporting an article to be protected by said paper protector in contacting relationship therewith;

inner panels around said central panel, each inner panel being hingedly connected to a respective outer edge of said central panel and extending upwardly at an angle thereto providing sides around said central panel forming a hollow article receiving chamber, said inner panels having inner and outer surfaces and outer extremities spaced from said central panel;

first mid panels hingedly connected to said outer extremities of said inner panels and folded at an angle outwardly therefrom with respect to said central panel, said first mid panels having upper and lower sides;

a second blank having a central opening of substantially the same shape as said central panel;

inner reinforcing panels around said central opening, each inner reinforcing panel being hingedly connected to an outer edge of said central opening and extending upwardly on said outer surface of a respective inner panel of said first blank;

a second mid panel on said second blank hingedly connected to said inner reinforcing panels and folded with respect thereto to extend substantially parallel to said first mid panels on said lower sides of said first mid panels in surrounding relationship with respect to said inner panels; and outer panels hingedly connected to outer extremities of said first mid panels and folded downwardly at an angle with respect thereto and with respect to said second mid panel forming hollow spaces between said inner panels and said outer panels having a width substantially the same as the width of said first and second mid panels to provide an impact absorbing zone substantially around said central panel for an article within said paper protector.

2. The paper protector as claimed in claim 1 and further comprising:

outer reinforcing panels hingedly connected to said second mid panel and folded at an angle relative thereto to extend on inner sides of said outer panels facing said hollow spaces for maintaining said width of said spaces between said inner and outer panels.

3. The paper protector as claimed in claim 2 and further comprising:

first gluing flaps on two of said outer reinforcing panels and hingedly connected thereto for folding at an angle thereto; and second gluing flaps on two of said outer panels and hingedly connected thereto for folding at an angle thereto into overlapping bonding relationship with said first gluing flaps.

* * * * *